US006062006A

United States Patent [19]

Jones

[11] Patent Number: 6,062,006

[45] Date of Patent: May 16, 2000

[54] SADDLE HORN FRICTION FITTING

[76] Inventor: Harold Jimmy Jones, 8908 Helmick Pl. NE., Albuquerque, N.Mex. 87122

[21] Appl. No.: 09/080,891

[22] Filed: May 18, 1998

[51] Int. Cl.[7] ..... B68C 1/00

[52] U.S. Cl. ..... 54/44.7; 54/44.1

[58] Field of Search ..... 54/44.1, 44.7

[56] References Cited

U.S. PATENT DOCUMENTS

| | | | |
|---|---|---|---|
| 1,106,648 | 8/1914 | Graves . | |
| 1,159,715 | 11/1915 | Schick | 54/44.1 |
| 3,258,894 | 7/1966 | Hoaglin | 54/44.7 |
| 3,388,530 | 6/1968 | Parker | 54/44.1 |
| 3,707,827 | 1/1973 | Strang | 54/44.1 |
| 4,265,075 | 5/1981 | Motsenbocker . | |

OTHER PUBLICATIONS

Cowboy Concepts "Supper Dalley", p. 114 of *Western Horseman*, published Feb. 1998.

*Primary Examiner*—Robert P. Swiatek
*Attorney, Agent, or Firm*—Robert W. Harris

[57] ABSTRACT

Rubber fitting for installation on the saddle horn of a conventional saddle, to enhance friction with the rope during the cattle roping process, and to remain securely attached to the horn as long as needed, being a one piece hollow cylindrical fitting in the form of a sleeve of molded rubber of a type which will produce good friction with the rope wrapped thereon, with an inner diameter sufficiently undersized in relation to the saddle horn that it achieves a tight, tensioned fit over the saddle horn, though large enough that it can be stretched to be installed over the saddle horn after soap lubrication of the saddle horn and the interior of the fitting; having alternate forms for differing pommel and forks of various saddle and horn geometries of different conventional saddles, with suitable angling of the top and bottom edges of the fitting for achieving optimum fit with the pommel, fork and saddle horn geometry of each saddle model, so that the bottom of the fitting, when installed, will fit flush against the saddle's pommel and fork, so that the rope may not work under the bottom edge of the fitting; and so that the forward edge of the top of the fitting will fit beneath the forwardly projecting cap at the top of the saddle horn, so as to further resist forces tending to lift the fitting off the saddle horn.

3 Claims, 2 Drawing Sheets

FIG. 1
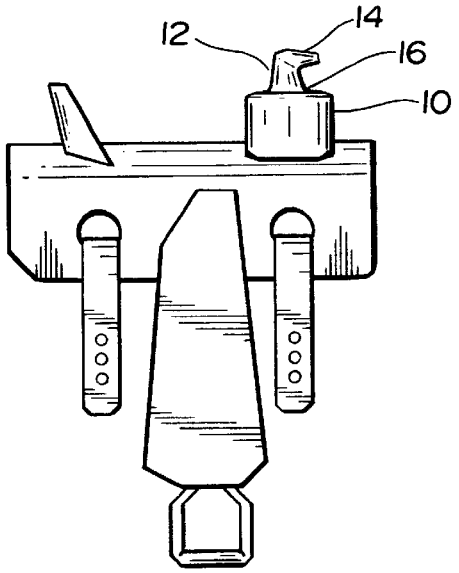
FIG. 2
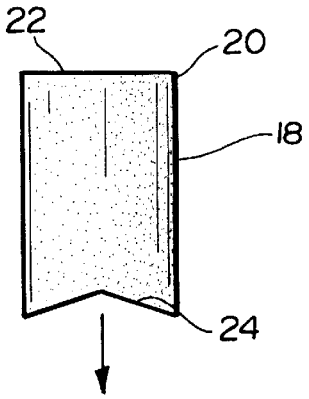
FIG. 4
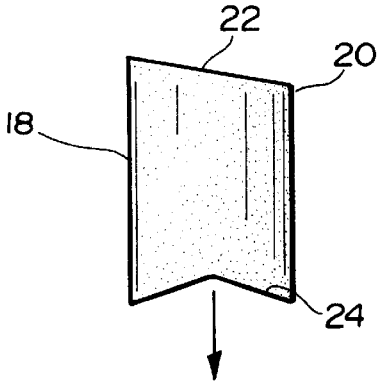
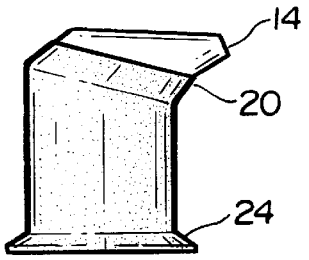
FIG. 3
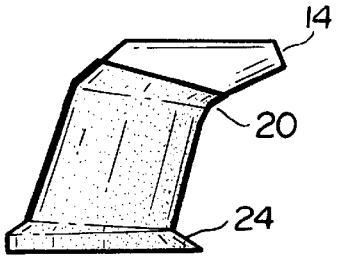
FIG. 5

SADDLE HORN FRICTION FITTING

BACKGROUND OF THE INVENTION

The invention concerns apparatus for enhancing the friction between the surface of a saddle horn and the rope used in cattle roping, for the purpose of adequately securing the rope to the saddle horn while also minimizing the number of times the rope must be looped about the horn.

When a cowboy ropes a horse, steer or other large animal while on horseback, he needs to very rapidly secure the rope to the saddle horn of his saddle, so as to be able to stop the roped animal. Because of the large weight of the roped animal, which may be running rapidly away from the cowboy's horse, very large forces are often exerted along the rope as the roped animal is being brought to a halt. It has been customary for the cowboy to wrap the rope one or more times around the saddle horn, to adequately secure the rope to the saddle horn by friction. Depending on the nature of the material of which the saddle horn is made, it may not afford sufficient friction unless the rope is looped around the horn several times, e.g. for a leather saddle horn. This presents a risk of rope burns and possibly even loss of fingers during the multiple looping process, as a result of the very large forces exerted along the rope by the animal being captured.

To deal with these problems, two approaches have previously been employed, as described in documents appended to applicant's Information Disclosure Statement. One has involved the practice of wrapping a strip of rubber several times around the saddle horn, so that better friction can be provided, by the rope/rubber interface, than would be provided by the rope/leather interface, in the case of a leather saddle horn with no wrapping. However, this approach has the disadvantage that the large forces exerted along the rope by the animal being halted, cause the rubber stripping to be strongly twisted about the saddle horn, due to the resulting torque. So the rubber stripping will often work loose, and often have to be rewrapped around the saddle horn.

Another prior art approach has been the use of a specially designed saddle horn, having a rubber outer layer, and having a special internal design of a form to resist twisting of the rubber layer about the axis of the saddle horn. But this approach offers nothing to allow rope friction enhancement in the use of a saddle and saddle horn of conventional design, lacking such a special design for the saddle horn.

So there is a need for a simple, inexpensive fitting which may be very simply and securely affixed to the exterior of a conventional saddle horn, to provide adequate friction with the rope with only one loop being made about the horn. And there is a need for such a fitting which will very tightly fit the saddle horn, so as to resist twisting forces and torque exerted by the rope, and which will have an upper forward portion fitting under the forwardly projecting cap of the saddle horn, to afford an additional means of securing the fitting to the saddle horn, and resisting forces tending to lift the fitting off of the horn.

There is also a need for such a fitting of a form at the bottom which will, when installed on the saddle horn, make a flush fit against the top of the pommel beneath the saddle horn, so as to prevent the rope from working under the bottom edge of the fitting; since, if the rope can work under the fitting, it would tend to lift the fitting off of the saddle horn, or work its way to the leather of the saddle horn, reducing friction.

These needs are met by applicant's invention, a single seamless hollow sleeve of vulcanized rubber, of a form suitably matching the pommel and saddle horn geometry but sufficiently undersized that it will, when installed on the horn, very tightly fit the horn, while yet having a large enough inside diameter that it can be installed on the horn, with use of suitable lubrication such as soap.

SUMMARY OF THE INVENTION

The present invention is a simple fitting for installation on the saddle horn of a conventional saddle, to enhance friction with the rope during the roping process, and to remain securely attached to the horn as long as needed. It is a one piece hollow cylindrical fitting in the form of a sleeve of molded rubber, vulcanized to be seamless, the rubber being of a type which will produce good friction with the rope wrapped thereon, with an inner diameter sufficiently undersized in relation to the saddle horn that it achieves a very tight, tensioned fit over the saddle horn, though large enough that it can be stretched to be installed over the saddle horn after soap lubrication of the saddle horn and the interior of the fitting. Alternate forms of the fitting, for differing pommel and saddle horn geometries of different conventional saddles, have suitable angling of the top and bottom edges of the fitting for achieving optimum fit with the pommel and saddle horn geometry, in two respects. First, the bottom of the fitting, when installed, will fit flush against the pommel, or flare out over the pommel, so that the rope may not work under the bottom edge of the fitting, which might tend to lift the fitting off of the saddle horn. Second, the forward edge of the top of the fitting will fit beneath the forwardly projecting cap at the top of the saddle horn, so as to further resist forces tending to remove the fitting from the saddle horn. The invention is a simple, inexpensive device intended for installation on saddle horns of existing conventional saddles, and so does not require any special construction of the saddle horn.

BRIEF DESCRIPTION OF THE DRAWINGS

FIG. 1 is an elevational view of a conventional prior art saddle of the general type with which the present invention may be used, without the present invention.

FIG. 2 is a side elevational view of a first embodiment of the present invention, shown by itself.

FIG. 3 is a side elevational view of the first embodiment of the invention, installed upon the saddle horn.

FIG. 4 is a side elevational view of a second embodiment of the invention, shown by itself.

FIG. 5 is a side elevational view of the second embodiment of the invention, installed upon a saddle horn of different geometry than the saddle horn shown in FIG. 3.

DESCRIPTION OF THE PREFERRED EMBODIMENTS

Figure 7:
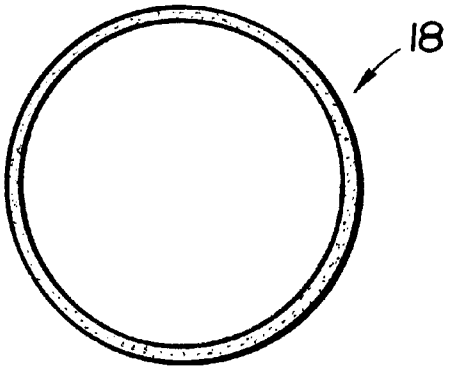
FIG. 7 is a plan view of the first embodiment of the invention, shown by itself, which is identical to a plan view of the second embodiment.
Figure 6:
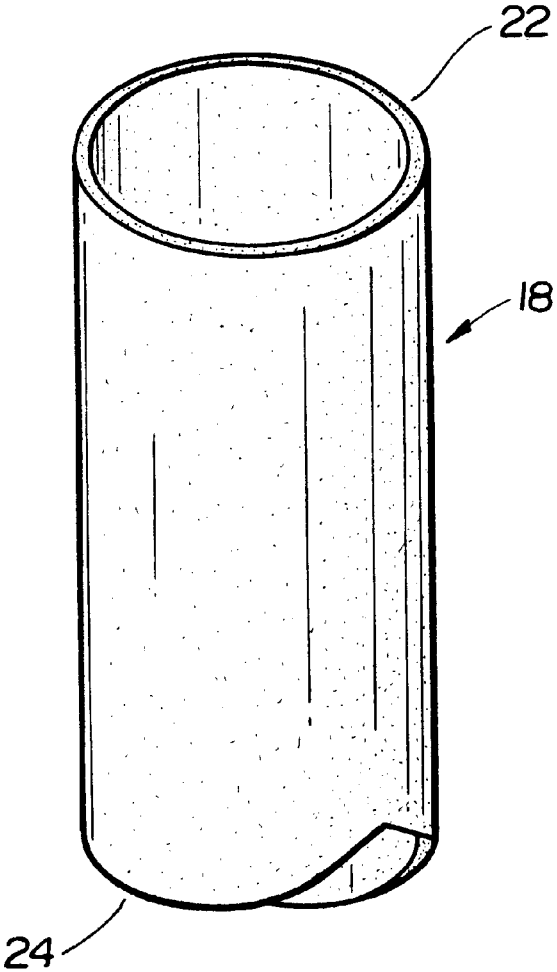
FIG. 6 is a perspective view of the second embodiment of the invention, shown by itself.

Referring now to the drawings, in which like reference numbers denote like or corresponding elements, FIG. 1 a prior art saddle of the type with which the present invention would be used, said saddle having a fork 10, and a saddle horn 12, with a forwardly projecting cap 14, with saddle horn 12 being securely affixed to the pommel 16 of fork 10. In conventional roping operations, the rope being used to stop an animal is rapidly wrapped around saddle horn 12, multiple times, in order to establish sufficient friction that the rope will be securely affixed to the saddle. If saddle horn 12 is not made of a material particularly suited for making good friction with the rope, e.g. leather, several wrappings of the rope may be needed.

A first embodiment of the present invention alone is shown in FIG. 2. The embodiment is a hollow, at least substantially cylindrical sleeve of rubber, open at the top and bottom, denoted generally 18, said rubber being of a type, as further detailed below, which is suitable for achieving high friction when wrapped with rope used in cattle roping. The sleeve 18 is made seamless by a suitable vulcanizing process, as detailed below.

The first embodiment is intended for use with a saddle horn 12 having a main body of at least substantially right cylindrical form, projecting vertically from pommel 16 of fork 10. Variations of the geometry of sleeve 18 will be made in alternate embodiments, to fit varying geometries of saddle horn 12, as further detailed below.

The inside diameter of sleeve 18 is made somewhat smaller than the outside diameter of the main body of saddle horn 12, while yet being close enough to the outside diameter of the main body of saddle horn 12, to allow that sleeve 18 may be-fit over saddle horn 12, after suitable lubrication of the exterior of saddle horn 12 and interior of sleeve 18, which lubrication may be accomplished using a coating of non-acidic, non-petroleum based soap on each of said surfaces. The inside diameter of sleeve 18 is enough smaller than the outside diameter of saddle horn 12, a typical size disparity being about 3/16 inch, so that a very tight fit is achieved, between sleeve 18 and saddle horn 12, when sleeve 18 is fit over saddle horn 12. This size disparity is one means whereby the preferred embodiments maintain secure fitting of the sleeve 18 with saddle horn 12, so as to tend to prevent undesired removal of sleeve 18 from saddle horn 12, as a result of the torque caused by the animal's pull along the rope.

The sleeve 18 is open at top and bottom so that it may be inserted over saddle horn 12, and so that there will be no trapped air at the top to impede pushing sleeve 18 fully down over saddle horn 12 in a tight fit with saddle horn 12, and also because there is no need to have sleeve 18 cover the top of saddle horn 12, since the rope is wrapped only around the sides of saddle horn 12.

Another means for maintaining such secure fitting, in the preferred embodiments, is the combination of suitable height of sleeve 18 and suitable angling of the upper and lower ends of the sleeve 18, to achieve secure fitting with the upper portion of the saddle horn 12, specifically the forwardly projecting cap 14, and also with the pommel 16 of fork 10.

For both the first embodiment shown in FIGS. 2 and 3, and the second embodiment shown in FIGS. 4 and 5, the sleeve 18 is of a height and form such that, when installed on saddle horn 12, the forward edge 20 of the top 22 of the sleeve 18 may be pushed down under the cap 14 of saddle horn 12. Because of the tight fit between saddle horn 12 and the sleeve 18, this geometry allowing the configuration having forward edge 20 beneath cap 14, offers an additional means of resisting forces tending to cause undesired removal of the sleeve 18 from saddle horn 12. For the embodiment of the invention shown in FIGS. 4 and 5, the saddle horn 12 has a forwardly slanting configuration. So, to achieve the above-described tight fit and configuration with this form of saddle horn 12, the sleeve 18 has a forwardly slanting form for the principal portion thereof, rather than a right cylindrical form, and has a forwardly slanting top 22, as shown in FIG. 4. However, for the form of saddle horn 12 for which the first embodiment of FIGS. 2 and 3 is intended, which saddle horn 12 has a main body of right cylindrical form, the right cylindrical form of sleeve 18 is appropriate, with a flat top 22 rather than a slanted one.

The bottom 24 of the sleeve 18 also has suitable angling, as shown in FIGS. 2 and 4, such that, when the sleeve 18 is fully fitted down over saddle horn 12, the bottom 24 will fit flush with pommel 16 of fork 10, and flare out onto the surface of pommel 16, if sleeve 18 is pushed further down on saddle horn 12, to prevent the rope from being able to work its way under the bottom 24. For if the rope is allowed to work its way under the bottom 24 of sleeve 18, this would also tend to allow the large forces exerted along the rope by the animal, to tend to pull the sleeve 18 off the saddle horn 12, or allow the rope to get to the surface of saddle horn 12, which surface is typically leather, thus reducing friction.

There is considerable variation in design among different saddles, as to the geometry of the fork and pommel; among different saddles, the pommel may be centered in the forward, middle, or rear portion of the fork, and the pommel may be flat or rounded where it joins the rest of the fork. By suitable angling of the bottom 24 of sleeve 18, to match the geometry of the particular pommel and fork, so that the bottom 24 of sleeve 18 fits flush against the pommel 16, the present invention dynamically forces the rope to roll up to the middle portion of sleeve 18, rather than working its way under the bottom 24 of sleeve 18.

The two embodiments shown in FIGS. 2–3, and FIGS. 4–5, are intended to illustrate that the precise form of the geometry of any particular embodiment of the sleeve 18, leaving aside the matter of size discussed above, is to be made to correspond to the geometry of the fork 10, pommel 16 and saddle horn 12 of the particular saddle for which that particular embodiment is made, so as to allow maintenance of a secure fit by the various means discussed above.

In the preferred embodiments the invention is made of rubber of a type providing good friction with the rope. A suitable rubber would be black entirely or at least mostly natural rubber, which may have as much as 30% by volume of synthetic butyl rubber added, to increase resistance to cutting and abrasion, and may also have color dyes added for merchandising purposes.

To produce copies of the invention of suitable size and geometry to fit particular saddles, and to also produce the invention in seamless form, the invention may be cured in molds of suitable geometry. A curing temperature of 200–310 degrees F., preferably 300 degrees F., and 100 PSI of outside mold pressure, and curing time of 40–70 minutes, preferably 55 minutes, is suitable for producing the invention in a form having good friction properties and adequate strength and toughness, and also allowing adequate escape of the gases naturally present in the rubber. Using these curing parameters, the invention has been produced in a form requiring 998 pounds of shear pull force to break or tear the invention.

Those familiar with the art will appreciate that the invention may be employed in configurations other than the specific forms disclosed herein, without departing from the essential substance thereof.

For example, and not by way of limitation, materials other than rubber of the kind described above for the preferred embodiments may be now or hereafter become available which would provide the necessary stretchability and toughness to achieve secure fit with the saddle horn 12 by the means described above, e.g. suitable plastics or other synthetic materials.

Similarly, additional means may be employed for the purpose of enhancing friction between the invention and the rope. For example, the outside surface of the sleeve 18 could be molded in a form having grooves and ridges matching the form of the rope to be used, so as to allow greater friction by providing greater contact surface area between the invention and the rope.

Also an additional sleeve may be installed over sleeve 18, to cushion impact or increase friction by sinking of the rope into more sleeve material.

The scope of the invention is defined by the following claims, including also all subject matter encompassed by the doctrine of equivalents as applicable to the claims.

I claim:

1. Fitting for use on a saddle in cattle roping operations in which cattle are lassoed with a rope, said fitting to be used on a saddle horn of a conventional saddle having on top of said saddle a fork with a pommel on top of said fork, and having a saddle horn with an exterior surface, said saddle horn projecting upward from said pommel, said fitting to be used to cover at least the major portion of said exterior surface of said saddle horn, and to wrap said rope around said fitting on said saddle horn during cattle roping operations, said fitting comprising:

a hollow sleeve, having a top and bottom and an interior surface and an exterior surface, said sleeve being open at both said top and said bottom of said sleeve, said sleeve further comprising:

(a) securing means, for maintaining said sleeve securely attached to said saddle horn, when said sleeve is fitted over said exterior surface of said saddle horn; and (b) friction means, for enhancing friction between said rope and said exterior surface of said sleeve;

wherein said securing means comprises: composition of said sleeve and relative dimensions of said sleeve and said saddle horn such that said interior of said sleeve is sufficiently undersized in relation to said exterior of said saddle horn, but wherein said sleeve is of sufficient size, strength and stretchability as to be stretchable to cover said saddle horn without tearing or breaking of said sleeve, such that when said sleeve covers said saddle horn, said sleeve will tightly fit said saddle horn.

2. Fitting for use on a saddle in cattle roping operations in which cattle are lassoed with a rope, said fitting to be used on a saddle horn of a conventional saddle having on top of said saddle a fork with a pommel on top of said fork, and having a saddle horn with an exterior surface, said saddle horn protecting upward from said pommel, said fitting to be used to cover at least the major portion of said exterior surface of said saddle horn, and to wrap said rove around said fitting on said saddle horn during cattle roping operations, said fitting comprising:

a hollow sleeve, having a top and bottom and an interior surface and an exterior surface, said sleeve being open at both said top and said bottom of said sleeve, said sleeve further comprising:

securing means, for maintaining said sleeve securely attached to said saddle horn, when said sleeve is fitted over said exterior surface of said saddle horn; and friction means, for enhancing friction between said rope and said exterior surface of said sleeve;

for use with said saddle where said saddle horn has a forwardly projecting cap at the top of said saddle horn, wherein said securing means comprises:

(a) composition of said sleeve and relative dimensions of said sleeve and said saddle horn such that said interior of said sleeve is sufficiently undersized in relation to said exterior of said saddle horn, but wherein said sleeve is of sufficient size, strength and stretchability as to be stretchable to cover said saddle horn; without tearing or breaking of said sleeve, such that when said sleeve covers said saddle horn, said sleeve will tightly fit said saddle horn;

(b) suitable angling of said bottom of said sleeve, such that, for the particular geometry of said saddle horn and said pommel and fork, said bottom of said sleeve will fit flush against said pommel when said sleeve is fully pushed down over said exterior surface of said saddle horn; and (c) suitable angling of said top of said sleeve, such that, for the particular geometry of said saddle horn and said pommel, a portion of said top of said sleeve adjacent to said cap of said saddle horn may be pushed under said cap when said sleeve has been pushed down fully over said saddle horn.

3. Fitting for use on a saddle in cattle roping operations in which cattle are lassoed with a rope, said fitting to be used on a saddle horn of a conventional saddle having on top of said saddle a fork with a pommel on top of said fork, and having a saddle horn with an exterior surface, said saddle horn projecting upward from said pommel, said fitting to be used to cover at least the major portion of said exterior surface of said saddle horn, and to wrap said rope around said fitting on said saddle horn during cattle roping operations, said fitting comprising:

a hollow sleeve, having a top and bottom and an interior surface and an exterior surface, said sleeve being open at both said top and said bottom of said sleeve, said sleeve further comprising:

(a) securing means, for maintaining said sleeve securely attached to said saddle horn, when said sleeve is fitted over said exterior surface of said saddle horn; and (b) friction means, for enhancing friction between said rope and said exterior surface of said sleeve;

wherein said securing means comprises: composition of said sleeve and relative dimensions of said sleeve and said saddle horn such that said interior of said sleeve is sufficiently undersized in relation to said exterior of said saddle horn, but wherein said sleeve is of sufficient size, strength and stretchability as to be stretchable to cover said saddle horn without tearing or breaking of said sleeve, such that when said sleeve covers said saddle horn, said sleeve will tightly fit said saddle horn;

wherein said interior of said sleeve is undersized by about 3/16 inch in diameter, in relation to said exterior of said saddle horn.

* * * * *